US006212990B1

(12) United States Patent
Elspass

(10) Patent No.: US 6,212,990 B1
(45) Date of Patent: Apr. 10, 2001

(54) CAM-CONTROLLED FIRING SYSTEM FOR A LARGE-CALIBER WEAPON

(75) Inventor: Marold Elspass, Kaarst (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/245,922

(22) Filed: Feb. 8, 1999

(30) Foreign Application Priority Data

Feb. 6, 1998 (DE) ..... 198 04 652

(51) Int. Cl.[7] ..... F41A 19/28
(52) U.S. Cl. ..... 89/28.1; 89/135; 42/69.01
(58) Field of Search ..... 42/69.01, 69.02; 89/132, 135, 136, 27.11, 1.813, 28.1

(56) References Cited

U.S. PATENT DOCUMENTS

| | | | | |
|---|---|---|---|---|
| 2,340,991 | | 2/1944 | Severance | 89/13 |
| 3,641,868 | * | 2/1972 | Reed | 89/1.813 |
| 3,786,716 | * | 1/1974 | Wilson | 89/1.812 |
| 4,112,818 | * | 9/1978 | Garehime, Jr. | 89/134 |
| 4,154,142 | | 5/1979 | Schwegler | 89/11 |
| 4,207,795 | * | 6/1980 | Reed et al. | 89/1.813 |

FOREIGN PATENT DOCUMENTS

| | | |
|---|---|---|
| 28437 | 10/1883 | (DE) . |
| 30263 | 1/1885 | (DE) . |
| 144075 | 6/1901 | (DE) . |
| 176867 | 12/1903 | (DE) . |
| 91 01 280 | 6/1991 | (DE) . |

* cited by examiner

*Primary Examiner*—Stephen M. Johnson
(74) *Attorney, Agent, or Firm*—Venable; Gabor J. Kelemen

(57) ABSTRACT

A firing system for a large-caliber weapon includes a firing pin displaceable into a position of rest, an armed position and a firing position; a spring urging the firing pin into the firing position; a follower affixed to the firing pin; and a rotatably supported control cam having a cam track. The spring urges the follower toward the cam track. The cam track has first, second and third consecutive cam track portions. The first cam track portion is shaped such that upon rotation of the control cam the firing pin is moved into the armed position by a cooperation between the follower and the first cam track portion. The second cam track portion is shaped such that upon continuing rotation of the control cam the firing pin is allowed to be accelerated by the spring into the firing position. The third cam track portion is shaped such that upon rotation of the control cam the firing pin is returned from the firing position into the position of rest by a cooperation between the follower and the third cam track portion. Further, an external drive is provided for rotating the control cam. An actuator operates the external drive for rotating the control cam through one cycle to effect consecutive cooperation between the follower and the first, second and third cam track portions.

7 Claims, 2 Drawing Sheets

CAM-CONTROLLED FIRING SYSTEM FOR A LARGE-CALIBER WEAPON

CROSS REFERENCE TO RELATED APPLICATION

This application claims the priority of German Application No. 198 04 652.9 filed Feb. 6, 1998, which is incorporated herein by reference.

BACKGROUND OF THE INVENTION

This invention relates to a firing system for a large-caliber weapon and includes a spring-loaded firing pin.

Conventional firing devices of the above-outlined type are described, for example, in the *Handbook on Weaponry, Second English-language Edition* (published by Rheinmetall GmbH, Düsseldorf, Germany, 1982); pages 343–346. The known firing devices outlined therein are disadvantageous in that they are of relative complex structure and are thus prone to malfunction or have only a fixedly installed firing pin.

SUMMARY OF THE INVENTION

It is an object of the invention to provide an improved firing system of the above-outlined type which is, in part, installed in the breechblock of the weapon and which is simple, compact and operationally safe and which furthermore is of lesser weight than conventional arrangements.

This object and others to become apparent as the specification progresses, are accomplished by the invention, according to which, briefly stated, the firing system for a large-caliber weapon includes a firing pin displaceable into a safety position (position of rest), an armed position and a firing position; a spring urging the firing pin into the firing position; a follower affixed to the firing pin; and a rotatably supported control cam having a cam track. The spring urges the follower toward the cam track. The cam track has first, second and third consecutive cam track portions. The first cam track portion is shaped such that upon rotation of the control cam the firing pin is moved into the armed position by a cooperation between the follower and the first cam track portion. The second cam track portion is shaped such that upon continuing rotation of the control cam the firing pin is allowed to be accelerated by the spring into the firing position. The third cam track portion is shaped such that upon rotation of the control cam the firing pin is returned from the firing position into the position of rest by a cooperation between the follower and the third cam track portion. Further, an external drive is provided for rotating the control cam. An actuator operates the external drive for rotating the control cam through one cycle to effect consecutive cooperations between the follower and the first, second and third cam track portions.

In essence, the invention is based on the principle that the motion of the firing pin is positively controlled during its entire cycle of displacement, that is, during its shift for arming the firing pin spring, during its forward acceleration to fire a shot and during its return motion into a position of rest. For this purpose, a follower affixed to the firing pin contacts the cam track of a control cam actuated by an external drive. The cam track of the control cam is of such a configuration that as the control cam starts to rotate in response to the actuation of a firing key, the follower first shifts the firing pin against the force of the firing pin spring towards the rearward end of the breechblock whereby the firing pin is armed. During continuing rotation of the control cam, the firing pin, after reaching a maximum rearward position, is allowed by the cam track to be accelerated forward by the force of the firing pin spring for igniting a cartridge in the weapon chamber. As the control cam rotates further, the cam track, as it cooperates with the follower, withdraws the firing pin into its safety position.

DESCRIPTION OF THE PREFERRED EMBODIMENT

Figure 1:
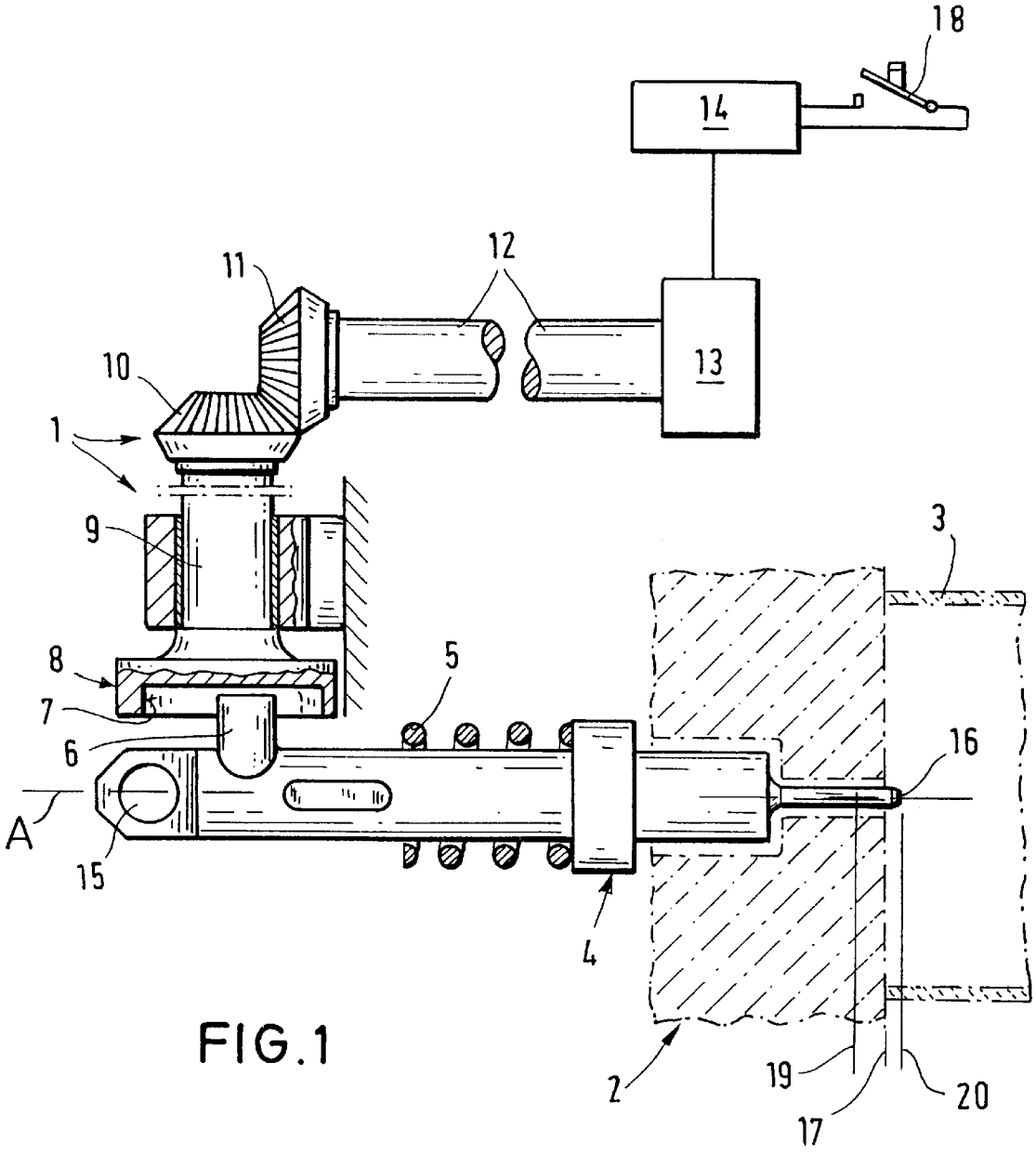
FIG. 1 is a schematic sectional side elevational view of a preferred embodiment of the invention.

FIG. 1 shows a firing mechanism 1 which is supported in an only symbolically shown breechblock 2 which closes the rear terminus of a weapon 3, for example, a mortar.

The firing mechanism 1 includes a firing pin 4 which has a longitudinal axis A and which passes through the breechblock 2. The firing pin 4 is axially slidably held in the breechblock 2 with the intermediary of a firing pin spring 5. A follower pin 6 is affixed to the firing pin 4 so that it projects from the firing pin 4 perpendicularly to the pin axis A. The follower 6 extends into a cam track 7 constituted by the hardened inner circumferential peripheral edge face of an annular cam disk 8. The cam disk 8 is affixed to one end of a shaft 9 whose other end is provided with a conical gear 10 which meshes with a conical gear 11 connected by means of an actuating shaft 12 with a cam disk drive 13 which is preferably an electric motor. The cam disk drive 13 is connected with a drive control device 14.

The firing pin 4 has, for emergency operation, on its side oriented towards the rearward end of the breechblock 2, an eyelet 15 to which a non-illustrated pull cord may be attached.

In the description which follows, the operation of the above-described firing system will be set forth in conjunction with FIGS. 2–7.

Figure 2:
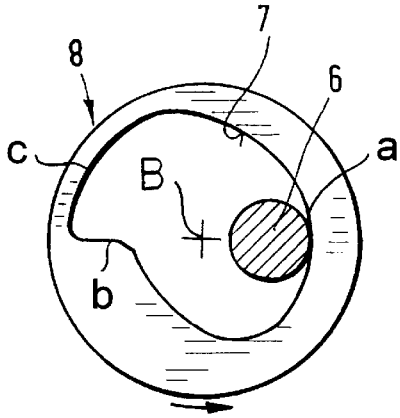
FIGS. 2–7 are bottom plan views of a component shown in FIG. 1 illustrating six different positions thereof after actuating a firing key.

In the position of rest (safety position) of the cam disk 8 shown in FIG. 2, the follower 6 engages a region (safety region) of the cam track 7, selected such that the tip 16 of the firing pin 4 is situated in the position designated at 17 in FIG. 1. In such a position (safety position or position of rest) the tip 16 of the firing pin 4 is, by virtue of the locking cooperation between the follower 6 and the cam track 7, prevented from contacting a cartridge which may be situated in the barrel 3 of the weapon.

Figure 3:
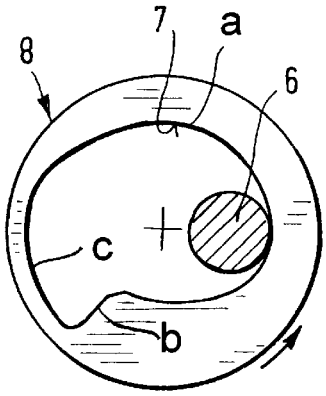
Figure 4:
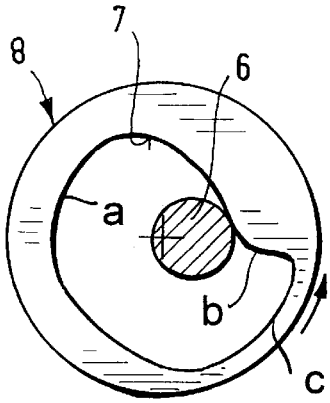
Figure 5:
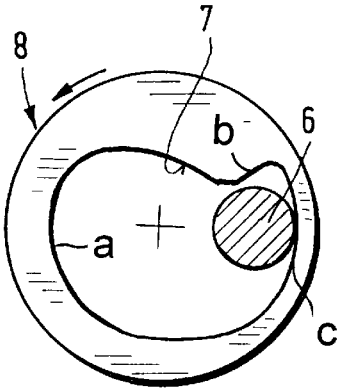

Upon depressing the firing key 18, the drive 13 is actuated which thus rotates the cam disk 8 about the stationary axis B in a counterclockwise direction by means of the force transmission components (shafts and meshing gears) 9–12. The portion of the cam track 7 which extends from location a to location b (viewed clockwise) and which adjoins the safety region, is of such a course that the follower 6 is displaced towards the left against the force of the firing pin spring 5 and thus the firing pin 4 is armed, as shown in FIGS. 3 and 4.

After the firing pin 4 has reached a maximum rearward-shifted position in which the firing pin tip 16 has reached its rearward-most position 19 shown in FIG. 1, the follower 6, by virtue of the configuration of the cam track portion which extends from b to c is released (FIG. 5) and thus the firing pin 4 may be accelerated forward by the firing pin spring 5, so that the firing pin tip 16 assumes its forward (firing) position designated at 20 in FIG. 1 and impacts on the primer of a cartridge situated in the weapon barrel 3. The cam track portion b-c is designed such that the follower 6, during forward acceleration of the firing pin 4, is out of contact with the cam track 7 when the firing pin 16 penetrates into the primer of a cartridge.

Figure 6:
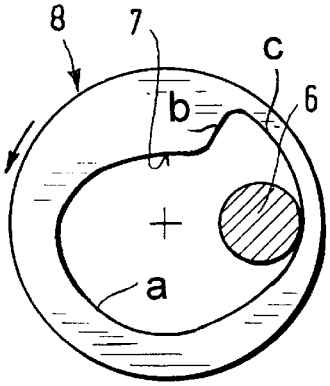
Figure 7:
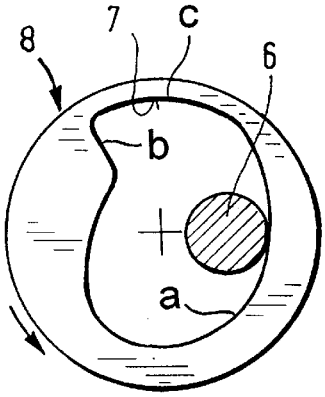

The cam disk 8 continues to rotate with constant velocity, so that, as shown in FIGS. 6 and 7, the cam track portion which extends from c to a draws the follower 6 and thus also the firing pin 4 from the firing position and moves it into the position of rest shown in FIG. 2. Upon reaching such a position, one firing cycle is completed and the drive 13 is automatically switched off by the drive control device 14.

To ensure an operationally reliable functioning of the firing mechanism according to the invention, it is of importance that the firing step be executed only if the normally locked firing key is actuated. Further, the firing pin spring 5 should be armed (tensioned) only shortly prior to the triggering of the igniting step and should be in a relaxed state at all other times. Also, the firing mechanism should be designed such that the firing pin tip does not project into the barrel 3 in its position of rest.

It will be understood that the above description of the present invention is susceptible to various modifications, changes and adaptations, and the same are intended to be comprehended within the meaning and range of equivalents of the appended claims.

What is claimed is:

1. A firing system for a large-caliber weapon comprising (a) a firing pin displaceable into a position of rest, an armed position and a firing position;

(b) a spring urging said firing pin into said firing position;

(c) a follower affixed to said firing pin;

(d) a rotatably supported control cam having a cam track, said control cam being an annular disk having an inner periphery constituting said cam track; said spring urging said follower toward said cam track; said cam track having (1) a first cam track portion being shaped such that upon rotation of said control cam said firing pin is moved into said armed position by a cooperation between said follower and said first cam track portion;

(2) a second cam track portion being shaped such that upon rotation of said control cam said firing pin is allowed to be accelerated by said spring into said firing position; and (3) a third cam track portion being shaped such that upon rotation of said control cam said firing pin is returned from said firing position into said position of rest by a cooperation between said follower and said third cam track portion;

(e) an external drive for rotating said control cam; and (f) an actuator for actuating said external drive for rotating said control cam through a cycle to effect consecutive cooperations between said follower and said first, second and third cam track portions.

2. The firing system as defined in claim 1, wherein said firing pin has a longitudinal axis and further wherein said follower projects from said firing pin perpendicularly to said axis.

3. The firing system as defined in claim 1, wherein said actuator comprises a firing key having active and inactive positions; when placed from said inactive position into said active position, said firing key operates said actuator for moving said control cam through said cycle.

4. The firing system as defined in claim 1, wherein said cycle comprises a 360° rotation of said control cam.

5. The firing system as defined in claim 1, wherein said external drive comprises an electric motor.

6. The firing system as defined in claim 1, wherein said firing pin includes means for securement of a pull cord thereto.

7. The firing system as defined in claim 1, wherein said firing pin has a longitudinal axis and said control cam rotates about an axis substantially perpendicular to the longitudinal axis.

* * * * *